US006319363B1

(12) United States Patent
Ruf et al.

(10) Patent No.: US 6,319,363 B1
(45) Date of Patent: Nov. 20, 2001

(54) SHEET FORMING SYSTEM AND METHOD FOR CONTROLLING THE SAME

(75) Inventors: Wolfgang Ruf, Herbrechtingen; Peter Mirsberger, Baienfurt; Holger Humberg, Nattheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/436,498

(22) Filed: Nov. 9, 1999

(30) Foreign Application Priority Data

Nov. 14, 1998 (DE) ..... 198 52 634

(51) Int. Cl.[7] ..... D21F 1/00

(52) U.S. Cl. ..... 162/203; 162/212; 162/301; 162/315; 162/336; 162/344

(58) Field of Search ..... 162/203, 212, 162/214, 301, 317, 315, 344, 347, 336

(56) References Cited

U.S. PATENT DOCUMENTS

| | | | | |
|---|---|---|---|---|
| Re. 25,333 | * | 2/1963 | Baxter, Jr. | 162/317 |
| 3,313,681 | * | 4/1967 | Dennis et al. | 162/336 |
| 3,450,596 | * | 6/1969 | Green | 162/301 |
| 3,619,362 | * | 11/1971 | Parker | 162/214 |
| 3,734,821 | * | 5/1973 | Curtis | 162/317 |
| 3,855,057 | * | 12/1974 | Hill | 162/317 |
| 4,124,441 | * | 11/1978 | Nykopp | 162/301 |
| 4,358,342 | | 11/1982 | Nuttall | 162/259 |
| 5,160,583 | * | 11/1992 | Eaton et al. | 162/301 |
| 5,252,186 | * | 10/1993 | Sollinger et al. | 162/301 |

FOREIGN PATENT DOCUMENTS

| | | |
|---|---|---|
| 3201369 | 10/1982 | (DE) . |
| 3841860 | 6/1990 | (DE) . |
| 4105215 | 8/1992 | (DE) . |

* cited by examiner

*Primary Examiner*—Karen M. Hastings
(74) *Attorney, Agent, or Firm*—Greenblum & Bernstein, P.L.C.

(57) ABSTRACT

A sheet forming system of a paper or cardboard machine. A headbox includes a headbox nozzle with to laterally extending side panels and first and second nozzle walls extending along a width of the machine. First and second screens converge in a region adjacent the headbox nozzle. At least two guide mechanisms, each having a guide surface, guide the first and second screens in the region. At least one support mechanism supports at least a portion of one of the first and second nozzle walls against said guide surface of at least one of said at least two guide mechanisms.

23 Claims, 8 Drawing Sheets

SHEET FORMING SYSTEM AND METHOD FOR CONTROLLING THE SAME

CROSS-REFERENCE TO RELATED APPLICATIONS

The present application claims priority under 35 U.S.C. § 119 of German Patent Application No. 198 52 634.2, filed on Nov. 4, 1998, the disclosure of which is expressly incorporated by reference herein in its entirety.

BACKGROUND OF THE INVENTION

1. Field of the Invention

The present invention is directed to a sheet forming system of a paper or cardboard machine, More specifically, the present invention is directed to a sheet forming system having a headbox with a nozzle and at least two guide mechanisms that guide screens in the region of the headbox nozzle over a guide surface.

2. Discussion of Background Information

A sheet forming system is disclosed in U.S. Pat. No. 4,358,342. This patent discloses the beginning of a sheet forming system of a papermaking machine with a twin wire former in the region of the headbox nozzle and the necked inlet gap of two screens. In the outlet region, the headbox nozzle has sectionally adjustable headbox lips that can influence or even out a base weight cross-direction profile of the paper web. Holding the upper and lower walls of the headbox nozzle in place requires a heavy and large support structure. To adjust the deformable upper or lower lip of the headbox, the relevant lip is supported on the heavily built base of die nozzle upper wall or nozzle lower wall.

Since this design requires a stable construction of the headbox up to the forward most region of the headbox nozzle, it is quite expensive. In addition, if the first two rolls of the screen section (that form the necked inlet gap) have large diameters, the headbox nozzle cannot be inserted far enough into the necked inlet gap. This results in a free jet that is too long, which decreases the quality of the manufacturing process.

German patent DE 41 05 215 C2 also discloses a sheet forming system in the region of the necked inlet gap of a twin screen section. In this system, the two rolls that form the necked inlet gap of the twin screen section are supported hydrostatically. The hydrostatic bearing across the width of the machine allows for compensation for deflection of the rolls. This uniformly maintains the inlet geometry of the necked gap over the entire width of the papermaking machine, even when small roll diameters are used.

SUMMARY OF THE INVENTION

The present invention provides a sheet forming system of a paper or cardboard machine with a headbox nozzle that is lighter than the prior art, yet which minimizes bending of the headbox nozzle.

According to an embodiment of the invention, a headbox nozzle includes two laterally arranged nozzle side panels, and first and second nozzle walls running the width of the machine. Two screens converge in the region of the output of the headbox nozzle. At least two guide mechanisms glide the screens in the region of the headbox nozzle over a guide surface. At least one support mechanism has at least one support element for supporting at least a portion of a nozzle wall against at least one guide surface.

The above embodiment may include various features At least one of the guide surfaces can be a roll surface and/or the surface of a guide shoe. At least one of the guide mechanisms can be a forming roll or a breast roll. The support elements of the support mechanism can be a roll or a shoe that slides or rolls over the roll surface. At least one of the support elements can haste at least one hydrostatic bearing or support. The support mechanism facing the nozzle wall may have at least one pressure chamber.

The support mechanism may be broken up into individual sections along the width of the machine that can be individually adjusted and controlled. Such a sectioned support may include a mechanism that controls the degree of support for each individual section. For example, control valves can individually control individual pressure chambers of the support mechanism. In the alternative, the support mechanism can also have a number of support elements (for example, individual spindles or hydraulic stamps), whose support action can be adjusted individually as needed.

The deflection of at least one of the guide mechanisms can be adjustable. A deflection compensation device, known per se for rolls, can be provided.

At least one supporting table with at least one pressure-producing device between the supporting table and the nozzle wall may be provided in the region of at least one nozzle wall. The pressure-producing device can have a single pressure chamber, or several individually controlled pressure chambers. Different pressure can be applied by the individual pressure chamber segments to produce a desired pressure cross-direction profile. The pressure-producing device is preferably upstream of the support mechanism between the nozzle wall and guide surface. In this arrangement, the supporting table is located relatively far from the necked inlet gap so that it has adequate space for a stable lower structure, unhindered by the rolls of the necked inlet gap.

According to an embodiment of the invention, a sheet forming system of a paper or cardboard machine is provided. A headbox had a headbox nozzle including two laterally extending side panels and first and second nozzle walls extending along a width of the machine. First and second screens converge in a region adjacent the headbox nozzle. At least two guide mechanisms, each having a guide surface, guide the first and second screens in the region. At least one support mechanism supports at least a portion of one of the first and second nozzle walls against the guide surface of at least one of the at least two guide mechanisms.

The above embodiment may have various features. At least one of the guide surfaces of the at least two guide mechanisms may be a roll surface or a surface of a guide shoe At least one of the at least two guide mechanisms can be one of a forming roll and a breast roll. At least one of the at least one support mechanism may be a roll or a shoe, and may have at least one of a hydrostatic bearing and support. The shoe may face the one of the first and second nozzle walls, and includes at least one pressure chamber.

The at least one support mechanism may be separated into a plurality of individual support mechanisms along a width of the machine. A control system may control the plurality of individual support mechanisms to adjust a degree of support provided along the width of the machine. The control system may individually control individual ones of the plurality of individual support mechanisms.

A deflection of at least one of the guide mechanisms may be adjustable.

The sheet forming system may her include at least one supporting table disposed in the one of the first and second nozzle walls, and at least one pressure-producing device between the supporting table and the one of the first and second nozzle walls. The pressure-producing device may include at least one pressure chamber, The at least one pressure chamber may include a plurality of pressure chambers along a width of the machine that can be individually controlled to apply different pressure. The pressure-producing device may be arranged upstream of the at least one support mechanism.

According to another embodiment of the invention, a sheet forming system of a paper or cardboard machine is provided. A headbox has a headbox nozzle including first and second nozzle walls extending along a width of the machine. First and second screens converge in a region adjacent the headbox nozzle. First and second guide rolls have first and second guide surfaces, respectively, that guide the first and second screens in the region. A support mechanism supports at least a part of the second nozzle wall against the second guide surface, the support mechanism being one of a roll and a shoe.

The above embodiment may have various features. The system may further include at least one supporting table disposed in the second nozzle wall, and at least one pressure chamber defined between the supporting table and the second nozzle wall. The one of roll and a shoe may include one of a plurality of individually elements, along a width of the machine that can be individually controlled to apply different pressure. The at least one pressure chamber may include a plurality of individually controlled pressure chambers along a width of the machine that can be individually controlled to apply different pressure.

In another embodiment of the invention, a sheet forming system of a paper or cardboard machine, includes a headbox with a headbox nozzle. The headbox nozzle includes first and second nozzle walls extending along a width of the machine. First and second screens converge in a region adjacent the headbox nozzle. First and second guide rolls have first and second guide surfaces, respectively, that guide the first and second screens in the region. A support mechanism supports at least a part of the second nozzle wall against the second guide surface, the support mechanism being one of a roll and a shoe At least one supporting table is disposed in the second nozzle wall. At least one pressure chamber defined between the supporting table and the second nozzle wall.

In yet another embodiment of the invention, a method for controlling a sheet forming system of a paper or cardboard machine is provided. The machine includes a headbox with a headbox nozzle. The headbox nozzle includes two laterally extending side panels and first and second nozzle walls extending along a width of the machine. First and second screens converge in a region adjacent the headbox nozzle. At least two guide mechanisms, each having a guide surface, and at least one support mechanism, are provided. The method includes guiding the first and second screens in the region via the at least two guide mechanisms, and supporting at least a portion of one of the first and second nozzle walls against the guide surface of at least one of the at least two guide mechanisms.

The at least one support mechanism may include a plurality of individual support mechanisms along a width of the machine. The method further includes controlling the plurality of individual support mechanisms to adjust a degree of support provided along the width of the machine.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present inventions the description taken with the drawings making apparent to those skilled in the art how the several forms of the present invention may be embodied in practice.

Figure 1A:
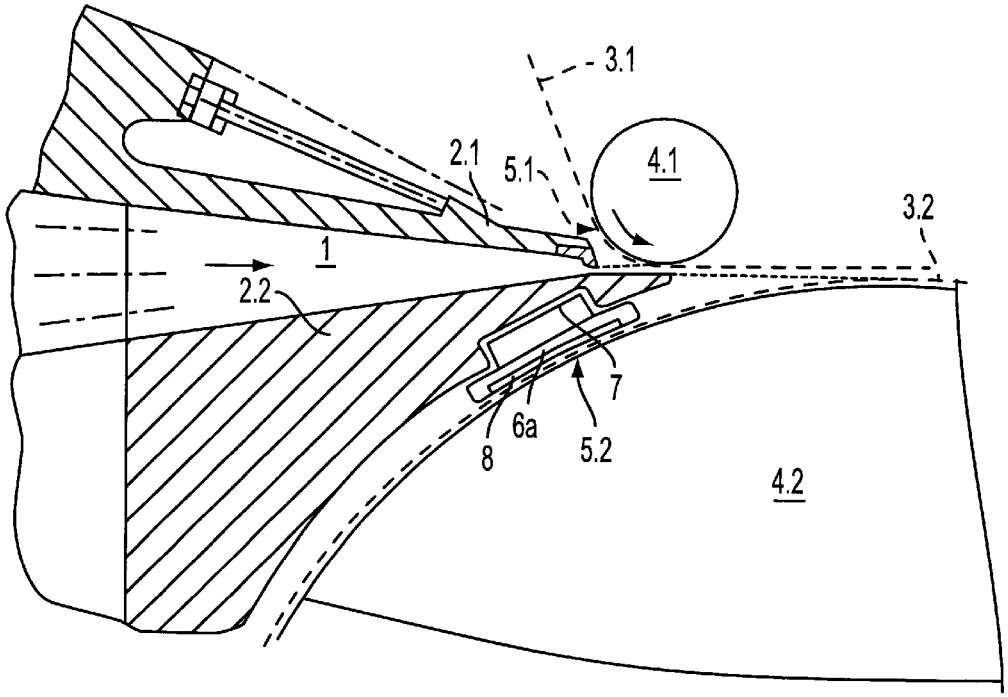
FIG. 1*a* is sheet forming system with a support element hydraulically supported against a guide surface.

Referring now to FIG. 1*a*, a sheet forming system is positioned in the region of the necked inlet gap of a twin wire papermaking machine. A headbox nozzle 1 includes two laterally arranged nozzle side panels 100 (FIGS. 1*b*–1*d*), and first and second nozzle walls 2.1 and 2.2 running along the width of the machine. The nozzle discharge opening of headbox nozzle 1 extends into the necked gap of the screen section. A guide mechanism 4.1, which is a guide roll in this embodiment and carries a screen 3.1, defines an upper side of the necked gap. A lower guide mechanism 4.2, which is a forming roll in this embodiment and carries a screen 3.2, defines the lower side of the necked gap.

In this embodiment, second nozzle wall 2.2 is the lower of the two nozzle walls 2.1 and 2.2. A support mechanism supports second nozzle wall 2.2 against a rotating guide surface 5,2 of guide mechanism 4.2. The support mechanism includes a support shoe 6*a*, which is hydrostatically supported on the side of second nozzle wall 2.2 by a pressure chamber 7. A pressure cushion 8 is provided on the screen side of support shoe 6*a*, with which support shoe 6*a* can support itself against guide surface 5.2 by way of a hydraulic cushion. Screen 3.2 runs between support shoe 6*a* and guide surface 5.2. Fluid for the hydraulic cushion can be supplied, for example, through direct introduction of fluid into the pressure cushion 8 through channels via the support shoe 6*a*, In the alternative, sufficient fluid can be applied to screen 3.2 ahead of support shoe 6*a* in the direction of rotation of guide mechanism 4.2 so that an appropriate quantity of fluid collects and builds the necessary counterpressure.

Figure 1B:
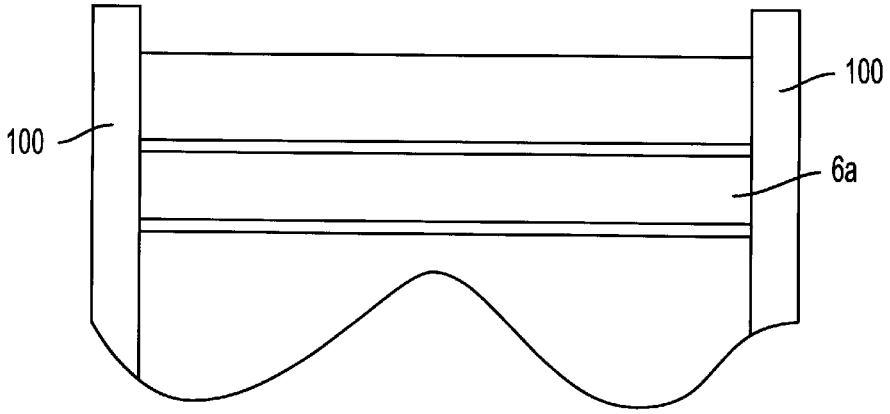
FIG. 1*b* is a cross section of the embodiment of FIG. 1*a* with a single support element runs across the width of the machine.
Figure 1C:
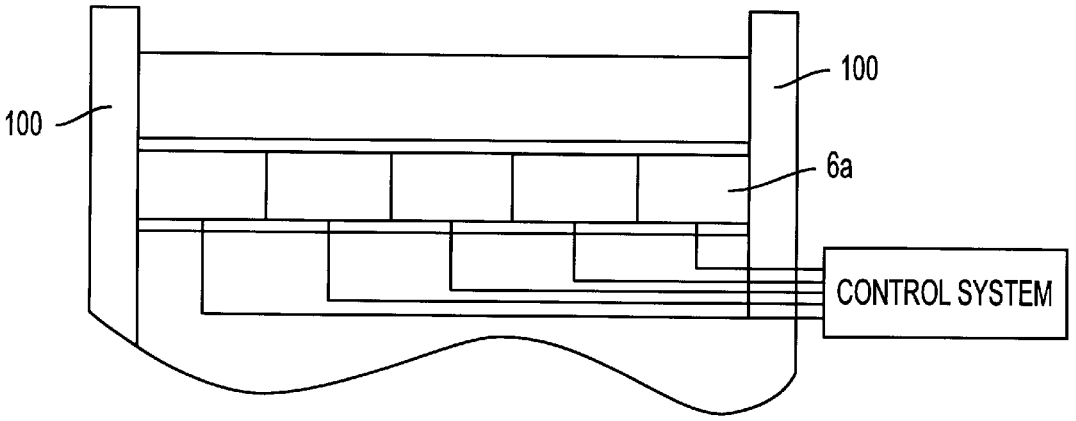
FIG. 1*c* is a cross section of the embodiment of FIG. 1*a* with a plurality of rectangular support elements running across the width of the machine.
Figure 1D:
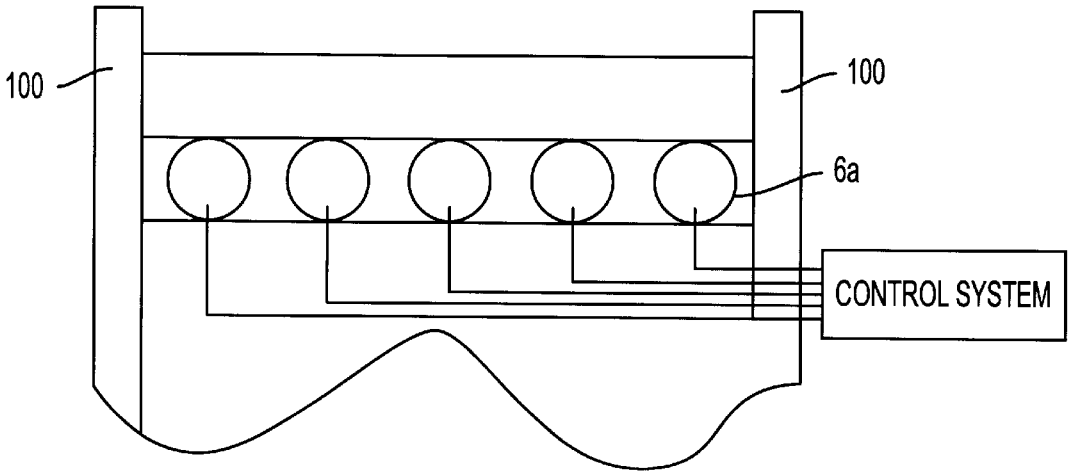
FIG. 1*d* is a cross section of the embodiment of FIG. 1*a* with a plurality of circular support elements running across tie width of the machine.

As shown in FIG. 1*b*, support shoe 6*a* may be a single unit running the width of the machine. As shown in FIGS. 1*c* and 1*d*, support shoe 6*a* may be a number of individually controllable pressure chambers, under control of a control system, across the width of the machine; although rectangular and circular segments are shown, the invention is not so limited, and other shaped may be used. Individual chambers allow the application of different individual pressures to profile the gap geometry of headbox nozzle 1. Headbox nozzle 1 can be made lighter using such a support mechanism.

Figure 1E:
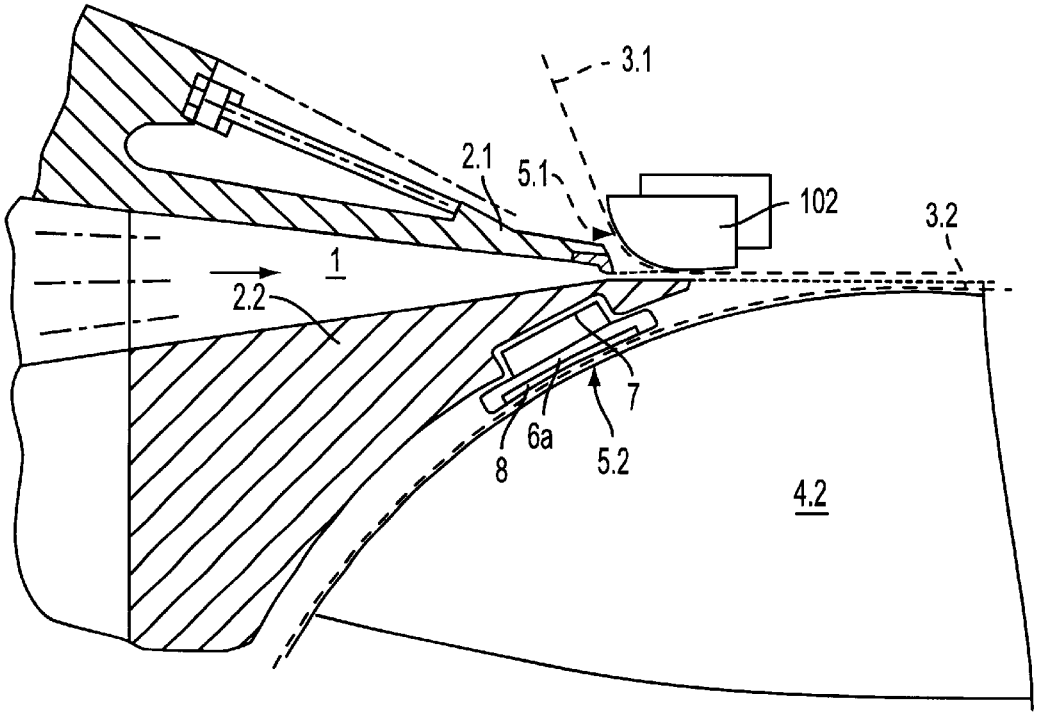
FIG. 1*e* is sheet forming system with a support element hydraulically supported against a guide surface, where the guide surface is a press shoe.

A variation of the above embodiment is shown in FIG. 1*e*,. In this modification, guide mechanism 4.1 is a press shoe 102 that carries screen 3.1. The embodiment is otherwise the same as shown in FIG. 1.

Figure 2A:
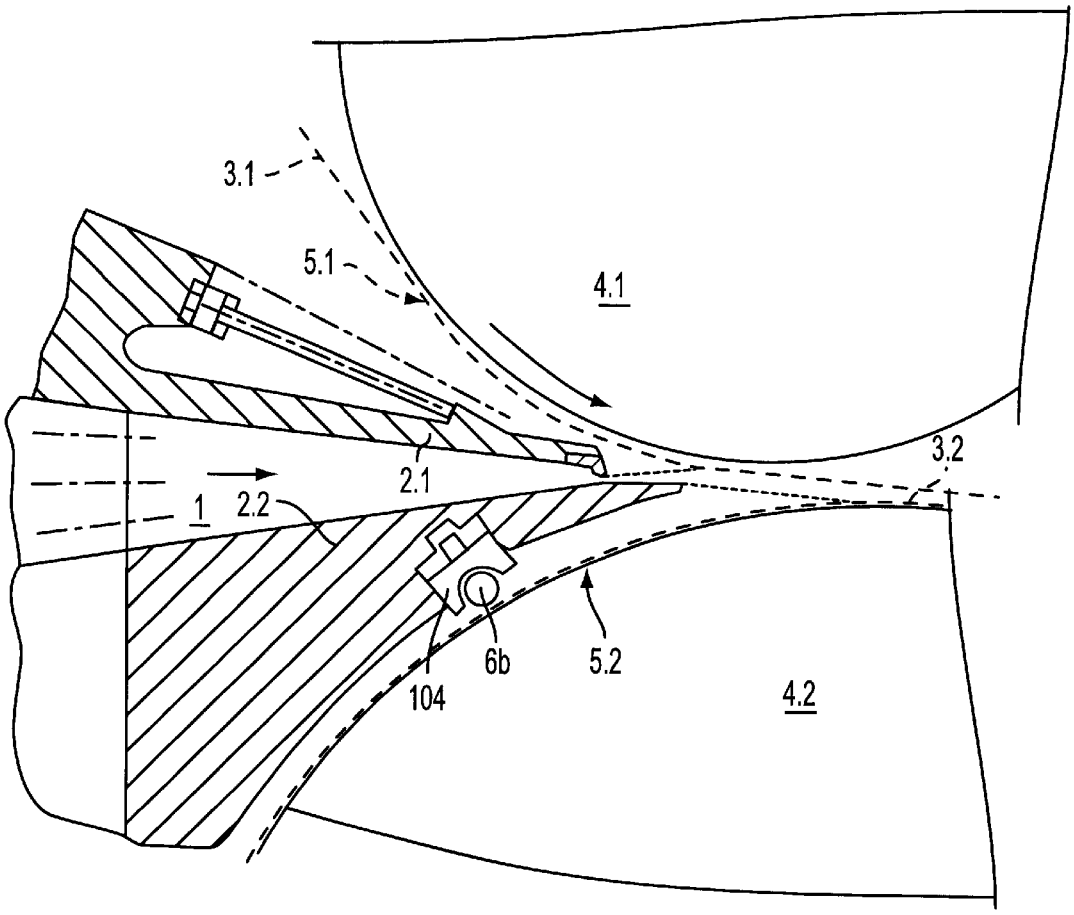
FIG. 2*a* is a sheet forming system with a roll as a support element against a guide surface.
Figure 2B:
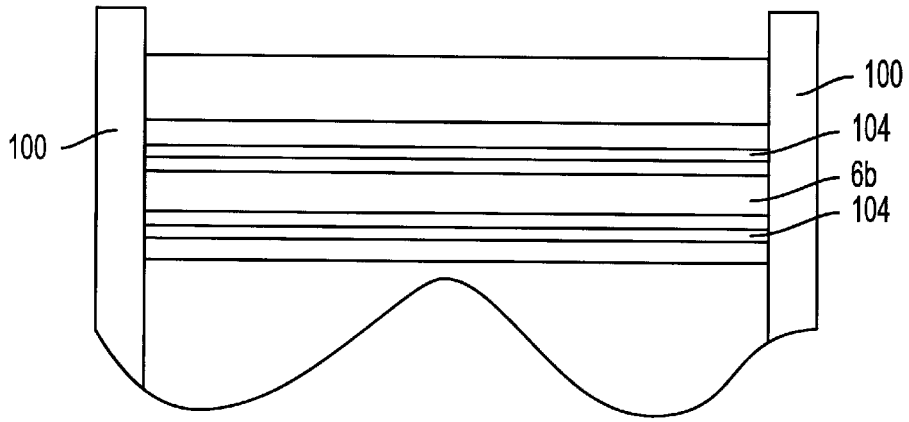
FIG. 2*b* is a cross section of the embodiment of FIG. 2*a* with a single support element runs across the width of the machine.
Figure 2C:
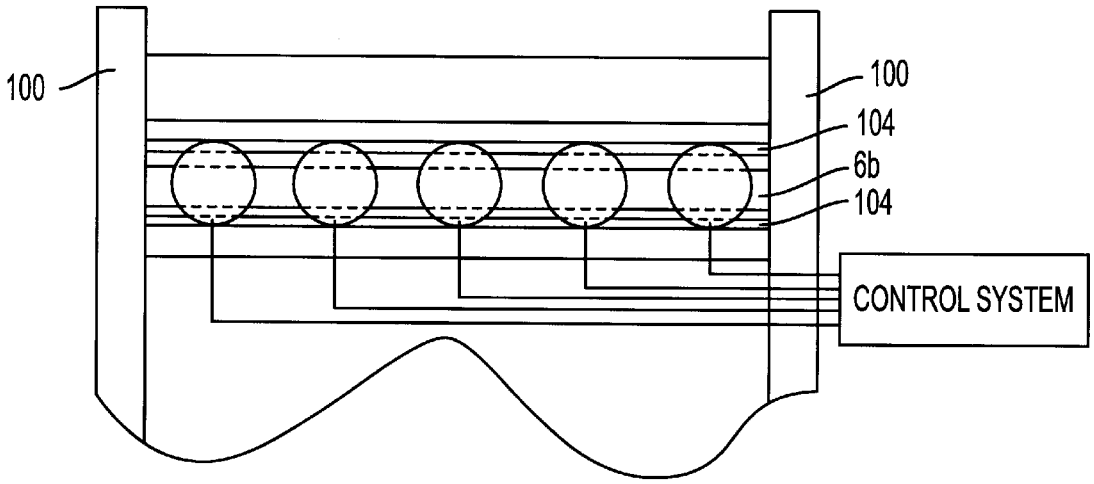
FIG. 2*c* is a cross section of the embodiment of FIG. 2*a* with a plurality of circular support elements running across the width of the machine.

Another embodiment of the invention is shown in FIG. 2. In FIG. 2, the support mechanism is a roller 6*b*. An appropriate pressure cushion (or cushions) can support a roller 6*b* hydrodynamically, as well as hydrostatically. The hydraulic support 104 can be uniform across roller 6*b* as in FIG. 2*b*, or separated into individual supports across the width of the machine as shown in FIG. 2*c*. As in the embodiment of FIG. 1*a*, individual support allows the application of different individual pressures to profile the gap geometry of headbox nozzle 1.

Figure 3:
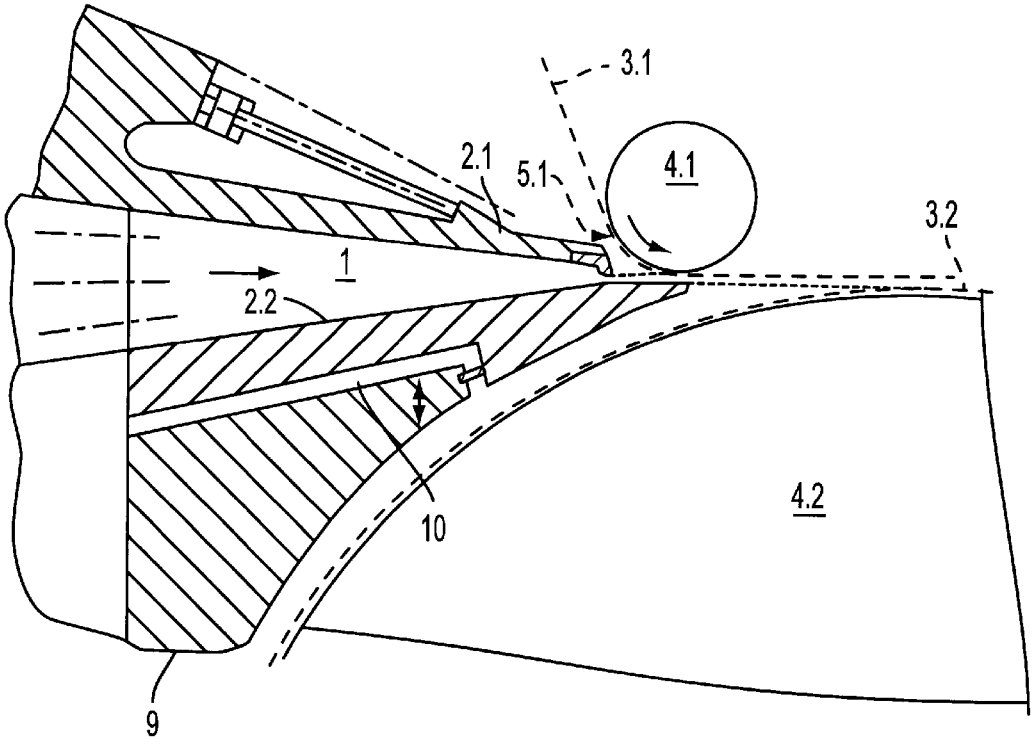
FIG. 3 is sheet forming system with a supporting table for a nozzle wall.

Another embodiment of the present invention is shown in FIG. 3. In this embodiment, second nozzle wall 2.2 has a recess in its rear section which, in conjunction with a supporting table 9 thereunder, defines a pressure chamber 10. Supporting table 9 is heavily built and absorbs compressive forces that anise within pressure chamber 10 across the width of the machine, where a certain deflection can arise in this region. The relatively thin second nozzle wall 2.2 above it does not bend due to the uniform pressure relationships, despite counterpressure from the nozzle chamber, As with the above embodiment, pressure chamber 10 can be a single unit or be separated into individual units across the width of the machine. Individual control of individual pressure chambers with the desired pressures can control the profile of the gap geometry of headbox nozzle 1.

Figure 4:
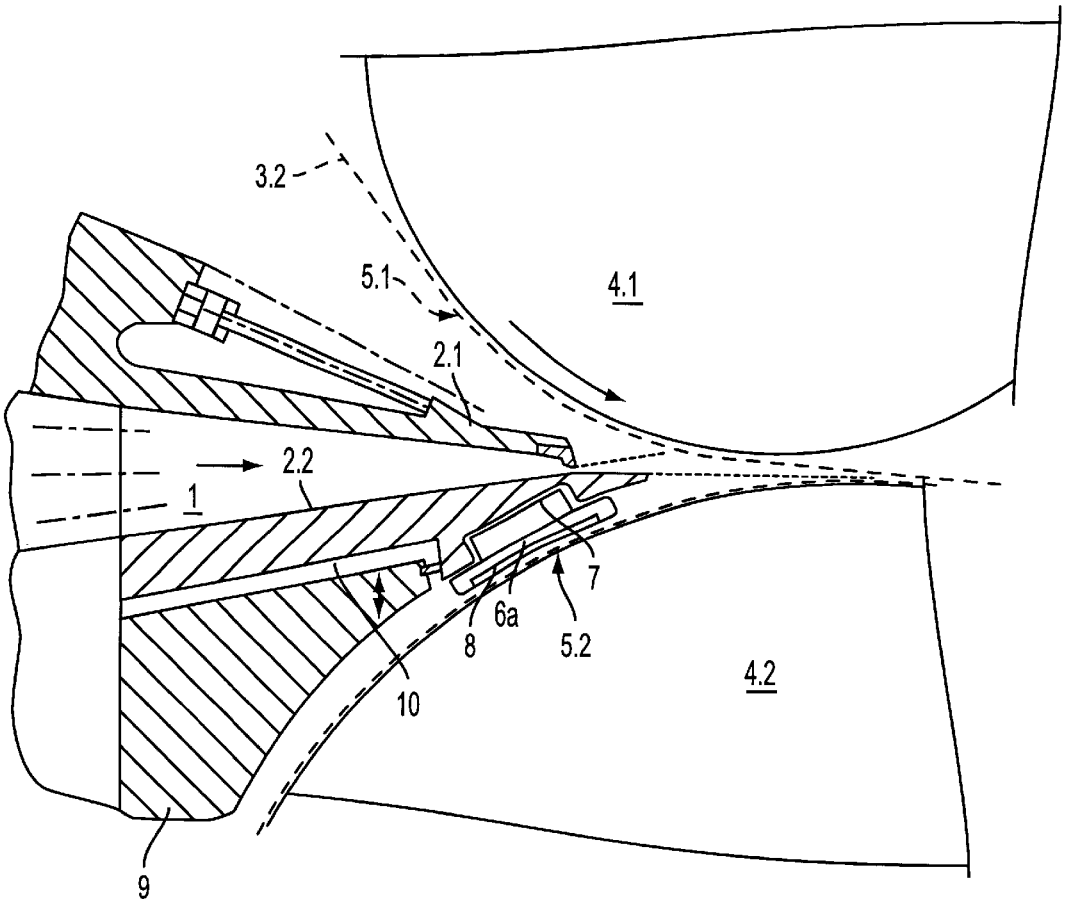
FIG. 4 is a sheet forming system with a support element hydraulically supported against a guide surface and an additional supporting table.

FIG. 4 shows another embodiment of the invention. This embodiment is a combination of hydrostatic support shoe 6*a* in the front region of the second nozzle wall 2.2 of the headbox nozzle 1 from the embodiment from FIG. 1*a*, and additional support in the rear region of the second nozzle wall 2.2 with the aid of supporting table 9 and pressure chamber 10 from FIG. 3.

Figure 5:
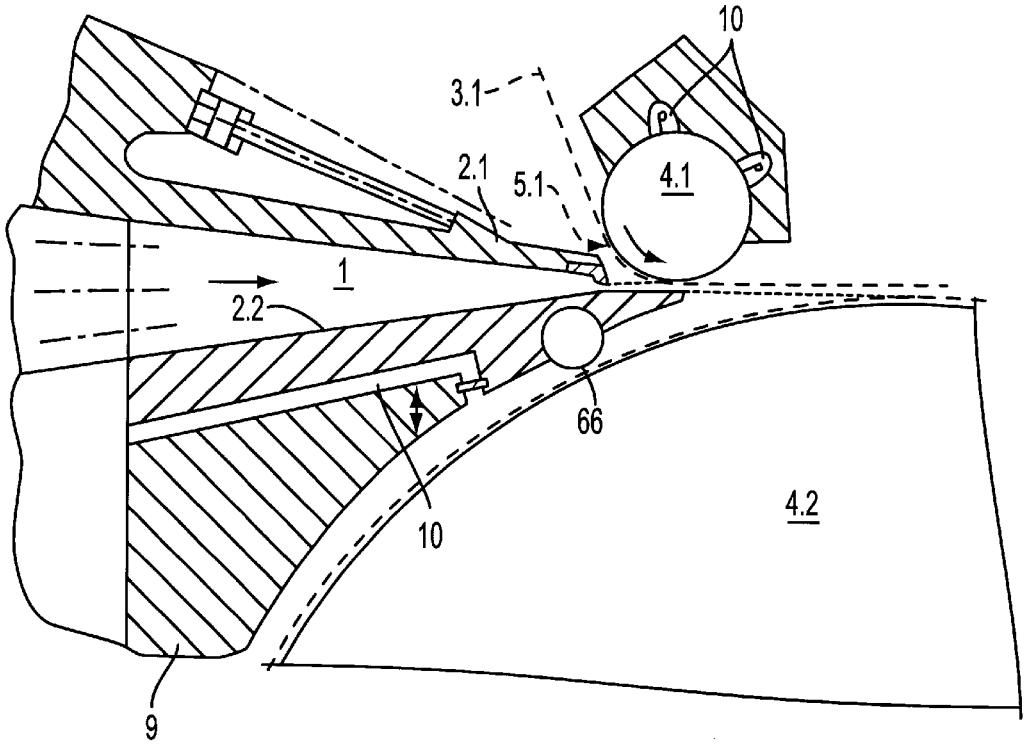
FIG. 5 is a sheet forming system with a roll as a support element against a guide surface, with an additional supporting table and hydrostatically supported guide roll on the opposite side of the guide surface.

FIG. 5 shows another embodiment of the invention. This embodiment is a combination of roller 6*b* in the front region of the second nozzle wall 2.2 of the headbox nozzle 1 from the embodiment from FIG. 2, and additional support in the rear region of the second nozzle wall 2.2 with the aid of supporting table 9 and pressure chamber 10 from FIG. 3. In addition, guide mechanism 4.1 is a guide roll which has a hydraulic support 11, and is thus designed with an adjustable profile across the width of the machine.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE DESIGNATOR LIST

1 headbox nozzle
2.1 nozzle wall
2.2 nozzle wall
3.1 screen
3.2 screen
4.1 guide mechanism
4.2 guide mechanism
5.1 guide surface
5.2 guide surface
6*a* support shoe
6*b* roller
7 pressure chamber
8 pressure cushion
9 supporting table
10 pressure chamber
11 hydraulic support
100 side panels
102 press shoe
104 hydraulic support

What is claimed is:

1. A sheet forming system of a paper or cardboard machine, comprising:

a headbox with a headbox nozzle, said headbox nozzle including two laterally extending side panels and first and second nozzle walls extending along a width of said machine;

first and second screens converging in a region adjacent said headbox nozzle;

at least two guide mechanisms, each having a guide surface, that guide said first and second screens in said region; and at least one support mechanism which supports at least a portion of one of said first and second nozzle walls against said guide surface of at least one of said at least two guide mechanisms.

2. The sheet forming system of claim 1, wherein at least one of said guide surfaces of said at least two guide mechanisms is a roll surface.

3. The sheet forming system of claim 1, wherein at least one of said guide surfaces of said at least two guide mechanisms is a surface of a guide shoe.

4. The sheet forming system of claim 1, wherein at least one of said at least two guide mechanisms is one of a forming roll and a breast roll.

5. The sheet forming system of claim 1, wherein at least one of said at least one support mechanism is a shoe.

6. The sheet forming system of claim 1, wherein said at least one support mechanism is separated into a plurality of individual support mechanisms along a width of said machine.

7. The sheet forming system of claim 6, further comprising a control system that controls said plurality of individual support mechanisms to adjust a degree of support provided along said width of said machine.

8. The sheet forming system of claim 6, wherein said control system individually controls individual ones of said plurality of individual support mechanisms.

9. The sheet forming system of claim 1, wherein a deflection of at least one of said guide mechanisms is adjustable.

10. The sheet forming system of claim 1, further comprising:

at least one supporting table disposed in said one of said first and second nozzle walls; and at least one pressure-producing device between said supporting table and said one of said first and second nozzle walls.

11. The sheet forming system of claim 10, wherein said pressure-producing device includes at least one pressure chamber.

12. The sheet forming system of claim 11, wherein said at least one pressure chamber includes a plurality of pressure chambers along a width of said machine that can be individually controlled to apply different pressure.

13. The sheet forming system of claim 10, wherein said pressure-producing device is arranged upstream of said at least one support mechanism.

14. A sheet forming system of a paper or cardboard machine, comprising:

a headbox with a headbox nozzle, said headbox nozzle including two laterally extending side panels and first and second nozzle walls extending along a width of said machine;

first and second screens converging in a region adjacent said headbox nozzle;

at least two guide mechanisms, each having a guide surface, that guide said first and second screens in said region; and at least one support mechanism which supports at least a portion of one of said first and second nozzle walls against said guide surface of at least one of said at least two guide mechanisms, wherein at least one of said at least one support mechanism is a roll.

15. The sheet forming system of claim 14, wherein said shoe faces said one of said first and second nozzle walls and includes at least one pressure chamber.

16. A sheet forming system of a paper or cardboard machine, comprising:

a headbox with a headbox nozzle, said headbox nozzle including two laterally extending side panels and first and second nozzle walls extending along a width of said machine;

first and second screens converging in a region adjacent said headbox nozzle;

at least two guide mechanisms, each having a guide surface, that guide said first and second screens in said region; and at least one support mechanism which supports at least a portion of one of said first and second nozzle walls against said guide surface of at least one of said at least two guide mechanisms, wherein at least one of said at least one support mechanism has at least one of a hydrostatic bearing and hydrostatic support.

17. A sheet forming system of a paper or cardboard machine, comprising:

a headbox with a headbox nozzle, said headbox nozzle including first and second nozzle walls extending along a width of said machine;

first and second screens converging in a region adjacent said headbox nozzle;

first and second guide rolls having first and second guide surfaces, respectively, that guide said first and second screens in said region; and a support mechanism which supports at least a part of said second nozzle wall against said second guide surface, said support mechanism being one of a roll and a shoe.

18. The system of claim 17, further comprising:

at least one supporting table disposed in said second nozzle wall; and at least one pressure chamber defined between said supporting table and said second nozzle wall.

19. The system of claim 17, wherein said one of roll and a shoe comprises one of a plurality of individually elements, along a width of said machine that can be individually controlled to apply different pressure.

20. The system of claim 18, wherein said at least one pressure chamber comprises a plurality of individually controlled pressure chambers along a width of said machine that can be individually controlled to apply different pressure.

21. A sheet forming system of a paper or cardboard machine, comprising:

a headbox with a headbox nozzle, said headbox nozzle including first and second nozzle walls extending along a width of said machine;

first and second screens converging in a region adjacent said headbox nozzle;

first and second guide rolls having first and second guide surfaces, respectively, that guide said first and second screens in said region;

a support mechanism which supports at least a part of said second nozzle wall against said second guide surface, said support mechanism being one of a roll and a shoe;

at least one supporting table disposed in said second nozzle wall; and at least one pressure chamber defined between said supporting table and said second nozzle wall.

22. A method for controlling a sheet forming system of a paper or cardboard machine, said machine including a headbox with a headbox nozzle, said headbox nozzle including two laterally extending side panels and first and second nozzle walls extending along a width of said machine, first and second screens converging in a region adjacent said headbox nozzle, at least two guide mechanisms, each having a guide surface, and at least one support mechanism, said method comprising:

guiding said first and second screens in said region via said at least two guide mechanisms;

supporting at least a portion of one of said first and second nozzle walls against said guide surface of at least one of said at least two guide mechanisms with said at least one support mechanism.

23. The method of claim 22, where said at least one support mechanism comprises a plurality of individual support mechanisms along a width of said machine, said method further comprising controlling said plurality of individual support mechanisms to adjust a degree of support provided along said width of said machine.

* * * * *